US012115462B2

(12) United States Patent
Wang et al.

(10) Patent No.: US 12,115,462 B2
(45) Date of Patent: Oct. 15, 2024

(54) DRIFT MOTORCYCLE

(71) Applicants: ALPHA GROUP CO., LTD., Guangdong (CN); GUANGZHOU ALPHA CULTURE COMMUNICATIONS CO., LTD., Guangdong (CN)

(72) Inventors: Weibin Wang, Guangdong (CN); Zefeng Chen, Guangdong (CN)

(73) Assignees: ALPHA GROUP CO., LTD., Guangdong (CN); GUANGZHOU ALPHA CULTURE COMMUNICATIONS CO., LTD., Guangdong (CN)

( * ) Notice: Subject to any disclaimer, the term of this patent is extended or adjusted under 35 U.S.C. 154(b) by 188 days.

(21) Appl. No.: 18/013,314

(22) PCT Filed: Apr. 15, 2021

(86) PCT No.: PCT/CN2021/087428
§ 371 (c)(1),
(2) Date: Dec. 28, 2022

(87) PCT Pub. No.: WO2022/001293
PCT Pub. Date: Jan. 6, 2022

(65) Prior Publication Data

US 2023/0311013 A1 Oct. 5, 2023

(30) Foreign Application Priority Data

Jun. 29, 2020 (CN) ..... 202021243529.3

(51) Int. Cl.
*A63H 17/21* (2006.01)
*A63H 17/00* (2006.01)

(52) U.S. Cl.
CPC ..... *A63H 17/004* (2013.01); *A63H 17/21* (2013.01)

(58) Field of Classification Search
CPC ..... A63H 17/21; A63H 17/26
See application file for complete search history.

(56) References Cited

U.S. PATENT DOCUMENTS 3,700,059 A * 10/1972 Sutton ..... B62K 5/10 180/209
4,290,228 A 9/1981 Goldfarb et al.
(Continued)

FOREIGN PATENT DOCUMENTS

CN 101288811 A 10/2008
CN 101631595 A 1/2010
(Continued)

OTHER PUBLICATIONS

Lucas Peter, "Supplementary European Search Report for EP application No. 21833038.9", Nov. 21, 2023, Munich, DE.

*Primary Examiner* — John A Ricci
(74) *Attorney, Agent, or Firm* — Bridgeway IP Law Group, PLLC; Jihun Kim

(57) ABSTRACT

A drift motorcycle includes a body and an advancing unit provided on the body and configured to provide advancing power for the body, and the body is further provided with a tilting unit and a transverse moving unit. The tilting unit is movably mounted on the body, and two ends of the tilting unit extend from two sides of the body to control the body to be switched between an upright state and a tilted state. The transverse moving unit is arranged at two sides of the body, and the transverse moving unit is configured to be in contact with a driving surface to generate a transverse power in a width direction of the body when the tilting unit controls the body to be switched to the tilted state.

10 Claims, 8 Drawing Sheets

(56) References Cited

U.S. PATENT DOCUMENTS

| | | | | |
|---|---|---|---|---|
| 4,601,674 | A * | 7/1986 | Koizumi | A63H 17/21 446/440 |
| 5,368,516 | A | 11/1994 | Hoeting et al. | |
| 5,820,439 | A * | 10/1998 | Hair, III | A63H 17/16 446/233 |
| 7,503,828 | B2 * | 3/2009 | Lee | A63H 17/36 446/460 |
| 7,581,611 | B1 * | 9/2009 | Kratz | A63H 17/21 180/224 |
| 7,610,131 | B2 * | 10/2009 | Kojima | A63H 17/395 446/457 |
| 7,643,933 | B2 * | 1/2010 | Hirata | A63H 17/26 700/62 |
| 7,896,725 | B2 * | 3/2011 | Lo | A63H 17/21 446/454 |
| 8,162,715 | B2 * | 4/2012 | Mayer | A63H 17/21 446/457 |
| 2011/0151747 | A1 | 6/2011 | Andres Berenguer et al. | |

FOREIGN PATENT DOCUMENTS

| | | | |
|---|---|---|---|
| CN | 202569545 | U | 12/2012 |
| CN | 108434753 | A | 8/2018 |
| JP | 2007020849 | A | 2/2007 |
| WO | 2009/157253 | A1 | 12/2009 |

* cited by examiner

DRIFT MOTORCYCLE

CROSS-REFERENCE TO RELATED APPLICATIONS

The present application is a National Stage of International Application No. PCT/CN2021/087428, filed on Apr. 15, 2021, which claims the benefit of priority to Chinese Application No. 202021243529.3, filed on Jun. 29, 2020, both of which are incorporated by reference herein in their entireties for all purposes.

TECHNICAL FIELD

The present disclosure relates to the field of toy vehicle technologies, and more particularly, to a drift motorcycle.

BACKGROUND

Toy motorcycles having a drifting function are more cool and fun than ordinary toy motorcycles in terms of driving skills and traveling smoothness. At present, the drifting function of toy motorcycles on the market achieves the drifting effect of lateral translation of the body by adding transverse wheels and controlling the steering of the transverse wheels. In the drifting process, a body of the motorcycle does not tilt, so that the drifting effect is not realistic enough, and the motorcycle is easy to roll over.

SUMMARY

The technical solution of the present disclosure provides a drift motorcycle. The drift motorcycle includes a body and an advancing unit arranged on the body and configured to provide advancing power for the body, and the body is further provided with a tilting unit and a transverse moving unit; the tilting unit is movably mounted on the body, and two ends of the tilting unit extend from two sides of the body to control the body to switch between an upright state and a tilting state; and the transverse moving unit is arranged at two sides of the body, and the transverse moving unit is in contact with a traveling surface when the tilting unit controls the body to switch to the tilting state, to generate transverse power along a width direction of the body.

BRIEF DESCRIPTION OF THE DRAWINGS

With reference to accompanying drawings, the disclosed content of the present disclosure will become easier to understand. It should be understood that these accompanying drawings are only for the purpose of illustration and are not intended to limit the scope of protection of the present disclosure. In the figures.

Figure 1:
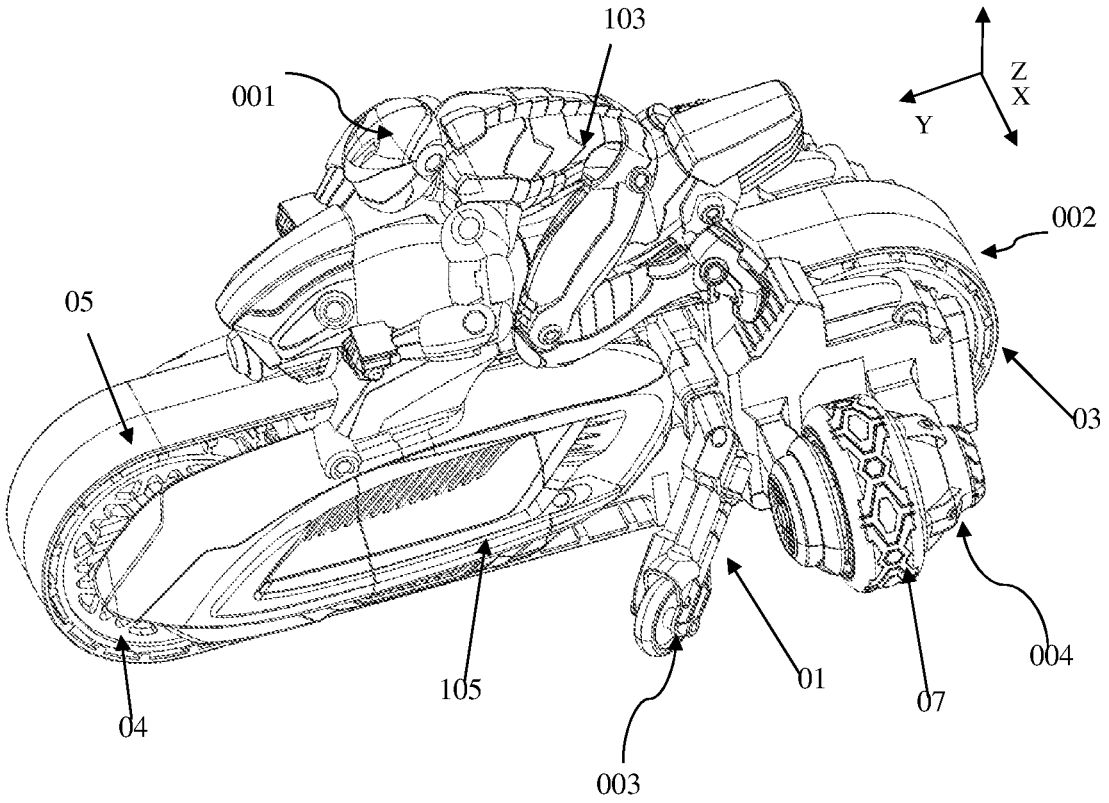
FIG. 1 is a schematic view of a drift motorcycle according to an embodiment of the present disclosure.

REFERENCE NUMERALS body 001:
- left housing 101, right housing 102, driver model 103, battery housing 104, battery cover 105 advancing unit 002:
- driving wheel 03, driven wheel 04, first snap portion 31/41, driving wheel shaft hole 32, shock mount 42;
- track 05: second snap portion 51;

tilting unit 003:
- balancing assembly 01: central swing member 11, swing gear 111, swing arm 12, first arm body 121, second arm body 122, roller 123;
- driving assembly 02: swing bar power device 21, swing bar transmission assembly 22, swing bar input gear 221, swing bar output gear 222, swing bar transmission gear 223, driving housing 23;
- balance detecting assembly 08;

transverse moving unit 004:
- power assembly 06: transmission shaft 61, rotating gear 611, driving wheel limiting shaft core 612, second bevel gear 62, driving motor 63, wheel transmission assembly 64, wheel input gear 641, wheel output gear 642, wheel transmission gear 643, wheel housing 65;
- side wheel assembly 07: wheel shaft 71, first bevel gear 72, side wheel 73, polygonal shaft hole 731;

power supply 005.

DETAILED DESCRIPTION

Specific implementations of the present disclosure will be further described below with reference to accompanying drawings.

It is easy to understand that according to the technical solution of the present disclosure, a variety of structural modes and implementation modes can be mutually replaced by those skilled in the art without changing the substantive spirit of the present disclosure. Therefore, the following specific implementations and accompanying drawings are only exemplary descriptions of the technical solution of the present disclosure, and should not be regarded as the whole of the present disclosure or as the limitation or restriction of the technical solution of the present disclosure.

The directional terms of up, down, left, right, front, rear, front side, rear side, top, bottom and other orientations mentioned or possibly mentioned in this description are defined relative to the structures shown in the accompanying drawings. They are relative concepts, so they may change accordingly according to their different positions and use states. Therefore, these or other directional location terms should not be interpreted as restrictive terms.

A drift motorcycle according to embodiments of the present disclosure, as shown in FIG. 1, includes a body 001 and an advancing unit 002 arranged on the body 001 and configured to provide advancing power for the body 001, and the body 001 is further provided with a tilting unit 003 and a transverse moving unit 004;

the tilting unit 003 is movably mounted on the body 001, and two ends of the tilting unit 003 extend from two sides of the body 001 to control the body 001 to switch between an upright state and a tilting state; and the transverse moving unit 004 is arranged at the two sides of the body 001. The transverse moving unit 004 is in contact with the traveling surface when the tilting unit 003 controls the body 001 to switch to the tilting state, to generate transverse power along a width of the body 001.

It should be noted that, as shown in FIG. 1, an X direction is a width direction of the body 001, a direction indicated by an X arrow is defined as a left side, and its opposite side is a right side. A Y direction is a length direction of the body 001, a direction indicated by a Y arrow is a front end, and its opposite end is a rear end. A Z direction is a height direction of the body 001, a direction indicated by a Z arrow is an upper side, and its opposite side is a lower side. The foregoing definitions will continue to be used later.

Specifically, the tilting unit 003 is configured to provide a tilting force for the body 001, and the transverse moving unit 004 is configured to provide transverse power for the body 001. The advancing power, the tilting force and the transverse power function jointly act on the body 001 to realize the tilt drifting.

Both the advancing unit 002 and the transverse moving unit 004 may be designed as wheels to drive the body 001 to move in the length direction Y and the width direction X through rolling of the wheels.

When the motorcycle moves forward, the tilting unit 003 does not provide the tilting force, the transverse moving unit 004 does not drive or is not in contact with the traveling surface, and the body 001 only moves forward under the advancing power provided by the advancing unit 002.

When the motorcycle drifts, the tilting unit 003 provides the tilting force by moving in the width direction X of the body 001 to tilt the body 001 to the left side or to the right side. The advancing unit 002 and the transverse moving unit 004 drive simultaneously to provide the advancing power and the transverse power for the body 001 respectively. The advancing power is along the length direction Y of the body 001, and the transverse power is along the width direction X of the body 001, the advancing power and the transverse power are perpendicular to each other, and combined action of the two types of power provides oblique power for the body 001. At this time, the body 001 tilts to the left side or to the right side and moves obliquely simultaneously, thus showing an effect of tilt drifting.

Figure 2:
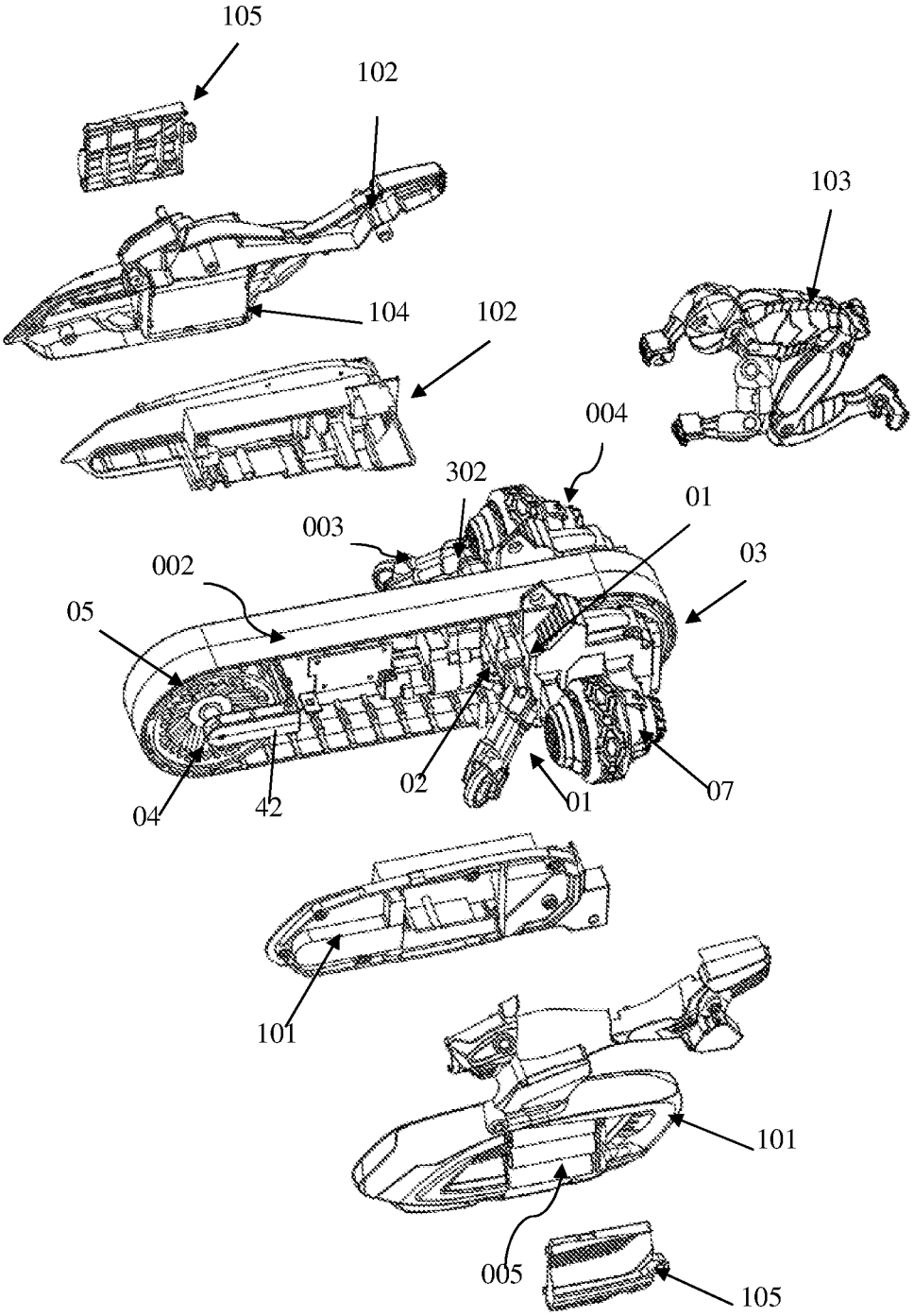
FIG. 2 is an exploded view of a drift motorcycle according to an embodiment of the present disclosure.

As shown in FIGS. 1 and 2, the body 001 may include a left housing 101 and a right housing 102 symmetrically arranged in a left-right direction. The left housing 101 and the right housing 102 are embedded with each other. The advancing unit 002, the tilting unit 003 and the transverse moving unit 004 are arranged between the left housing 101 and the right housing 102. In order to improve the simulation degree, a driver model 103 may further be mounted on the body 001, and the driver model 103 may be fixedly or detachably mounted on the left housing 101 and the right housing 102.

According to embodiments of the present disclosure, the advancing unit 002 and the transverse moving unit 004 drive the body 001 to move obliquely, and the body 001 is tilted through the cooperation of the tilting unit 003, thus realizing the effect of tilt drifting of the motorcycle, simulating the drifting process of the real motorcycle, and improving the driving skills and traveling smoothness of the motorcycle.

Figure 3:
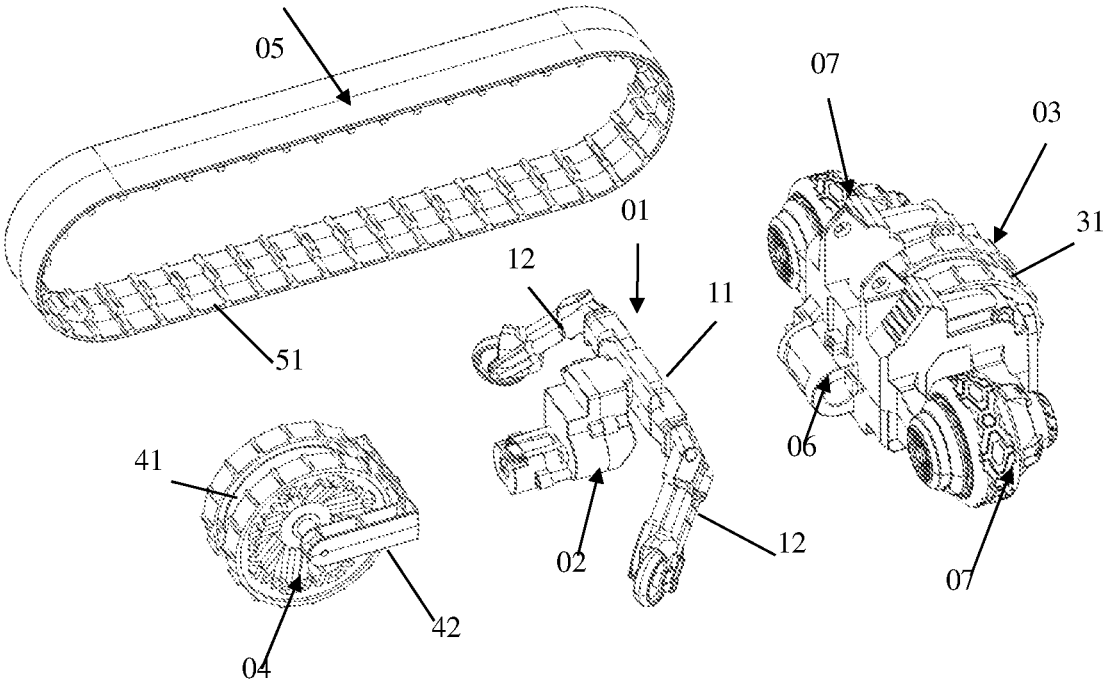
FIG. 3 is an exploded view of an internal structure of a drift motorcycle according to an embodiment of the present disclosure.

In one embodiment, as shown in FIG. 3, the tilting unit 003 includes a balancing assembly 01 and a driving assembly 02. The balancing assembly 01 is movably arranged on the body 001, and two ends of the balancing assembly 01 are located at two sides of the body 001 respectively. The balancing assembly 01 includes a balanced state and an unbalanced state;

the body 001 is in the upright state when the balancing assembly 01 is in the balanced state;

The body 001 is in the tilting state when the balancing assembly 01 is in the unbalanced state; and the driving assembly 02 is configured to drive the balancing assembly 01 to switch between the balanced state and the unbalanced state.

Specifically, the balancing assembly 01 is arranged along the width direction X of the body 001. The two ends of the balancing assembly 01 are located at the left side and the right side of the body 001 respectively. The driving assembly 02 causes the left side and the right side of the body 001 to be unbalanced by driving the balancing assembly 01 to move, thus changing a center of gravity of the body 001 and tilting the body 001.

The driving assembly 02 may control the balancing assembly 01 to move in the width direction X of the body 001, and may further control the balancing assembly 01 to rotate relative to the body 001.

In the tilting unit 003 according to the embodiments of the present disclosure, the movable balancing assembly 01 is mounted on the body 001, so that the weight and structure of the left side and the right side of the body 001 may become asymmetric, to tilt the body 001.

Figure 6:
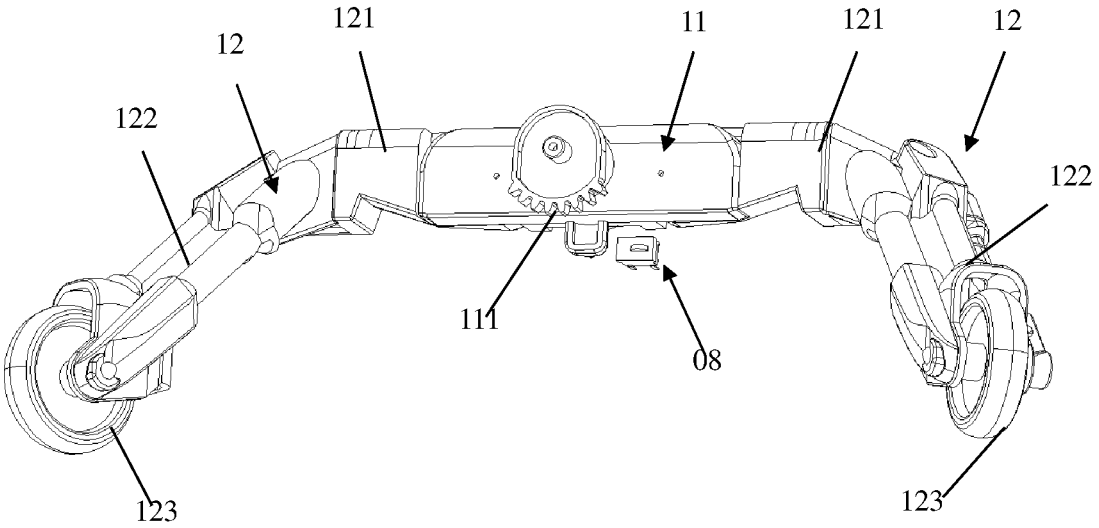
FIG. 6 is a schematic view of a balance detecting assembly according to an embodiment of the present disclosure.

In one embodiment, as shown in FIG. 6, the tilting unit 003 further includes a balance detecting assembly 08 mounted on the body 001, and the balance detecting assembly 08 is directly facing a center position of the balancing assembly 01 in the balanced state. The driving assembly 02 is controlled to stop driving in response to that the balance detecting assembly 08 detects that the balancing assembly 01 is in the balanced state when the balancing assembly 01 switches from the unbalanced state to the balanced state.

The balance detecting assembly 08 may be designed as a contact switch. The balancing assembly 01 is not in contact with the contact switch when it is in the unbalanced state. Only when the balancing assembly 01 is in the balanced state, it may be in contact with the contact switch. Therefore, the contact switch may detect whether the balancing assembly 01 is restored to the balanced state, so as to control the driving mechanism to stop driving.

Specifically, the balance detecting assembly 08 and the driving assembly 02 may communicate with each other through a controller, such as a one-chip computer. When the balance detecting assembly 08 detects the balancing assembly 01, the balance detecting assembly sends a signal to the controller, and the controller disconnects the power supply of the driving assembly 02, thus controlling the driving assembly 02 to stop driving, so that the balancing assembly 01 remains in the balanced state.

In one embodiment, as shown in FIGS. 3 to 6, the balancing assembly 01 is a swing bar, a length direction of the swing bar is arranged along the width direction X of the body 001, and two ends of the swing bar extend from the left side and the right side of the body 001 respectively; and the driving assembly 02 drives the swing bar to swing at the left side and the right side of the body 00; an end of the swing bar extending from one side of the left side and the right side abuts against the traveling surface when the swing bar swings towards the one side, to tilt the body 001 towards the other side.

The swing bar is arranged symmetrically in the left-right direction; when the body 001 is in the upright state, a length of the swing bar extending from the left side and a length of the swing bar extending from the right side of the body 001 are identical, and the swing bar is in the balanced state; and at this time, the body 001 is symmetrical in the left-right direction;

when the body 001 drifts towards the left side, the swing bar swings towards the right side, to provide the body with a swing force towards the left side, so that the body 001 tilts towards the left side; and when the body 001 drifts towards the right side, the swing bar swings towards the left side, to provide the body with a swing force towards the right side, so that the body 001 tilts towards the right side.

Figure 4:
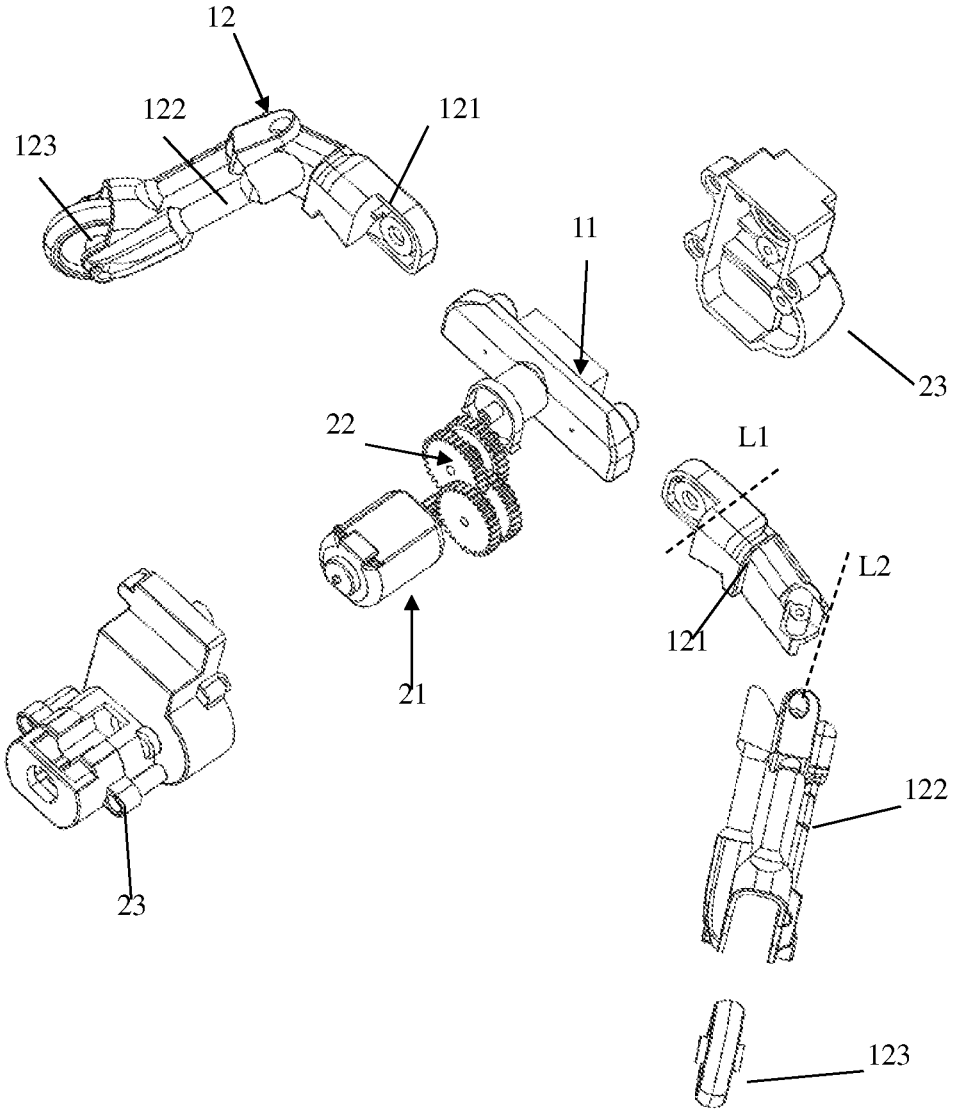
FIG. 4 is an exploded view of a tilting unit according to an embodiment of the present disclosure.
Figure 5:
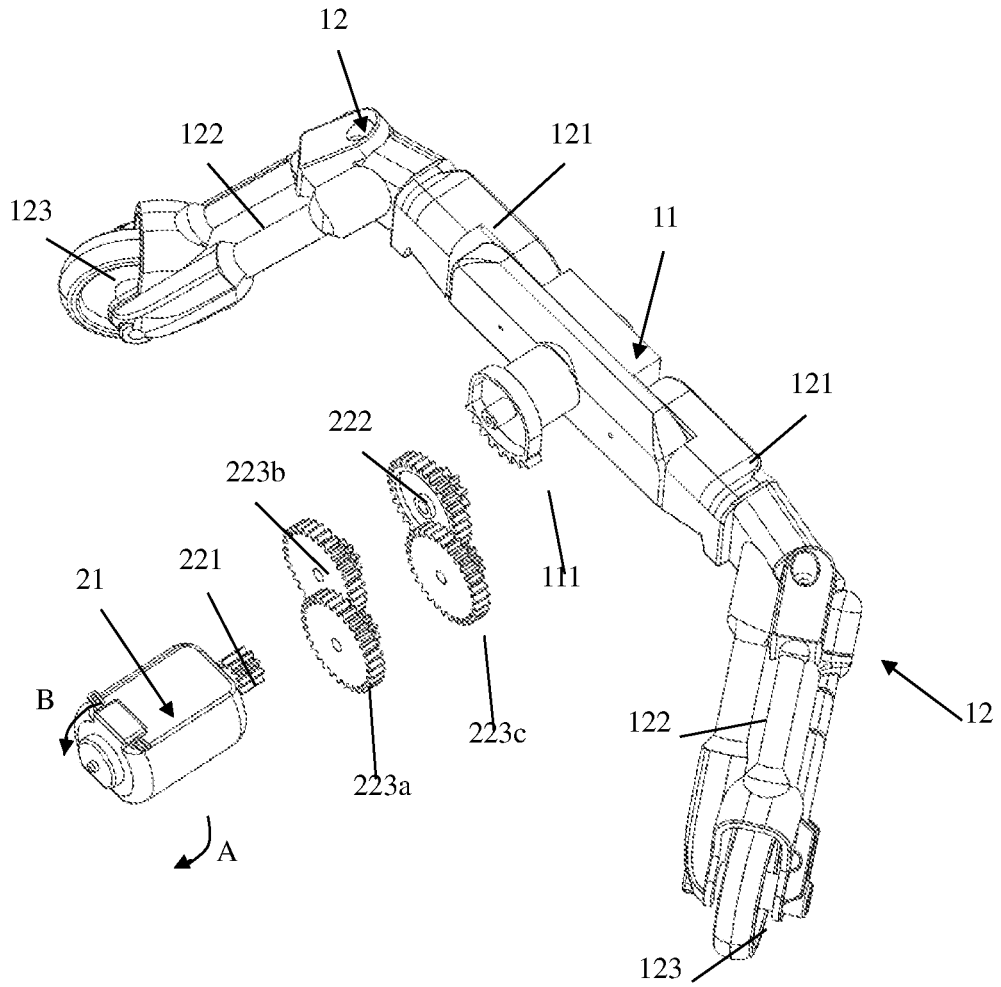
FIG. 5 is an exploded view of a driving assembly according to an embodiment of the present disclosure.

Specifically, as shown in FIGS. 4 and 5, the swing bar includes a central swing member 11 and two swing arms 12 rotatably coupled to two ends of the central swing member 11. The swing arm 12 extends obliquely towards the traveling surface, a coupling end of the swing arm 12 is resiliently and rotatably coupled to the central swing member 11. A free end of the swing arm 12 at one side of the body abuts against the traveling surface when the central swing member 11 swings towards the one side of the body 001, to provide a reverse pushing force for the body 001, and to push the body 001 to the other side of the swing arm 12, thus tilting the body 001, and preventing the body 001 from rolling over effectively by the abutment of the swing arm 12 against the traveling surface.

An upper end of the swing arm 12 is the coupling end coupled to the central swing member 11, and a lower end is the free end. The central swing member 11 is configured to couple to the driving assembly 02. When the driving assembly 02 drives the central swing member 11 to swing to the left, the swing bar moves to the left side as a whole, and at this time, the lower end of the swing arm 12 on the left side abuts against the traveling surface, to push the body 001 to tilt to the right side. When the driving assembly 02 drives the central swing member 11 to swing to the right, the swing bar moves towards the right side as a whole, and at this time, the lower end of the swing arm 12 on the right side abuts against the traveling surface, to push the body 001 to tilt to the left side.

The swing arm 12 is resiliently and rotatably coupled to the central swing member 11. The swing arm 12 is squeezed by the traveling surface and rotates slightly relative to the central swing member 11 when the lower end of the swing arm 12 abuts against the traveling surface. If the body 001 returns to the upright state, the swing arm 12 is resiliently restored. This arrangement reduces the impact on the swing arm 12 when the body 001 tilts, and prevents the swing arm 12 from being damaged.

The driving assembly 02 includes a swing bar power device 21 and a swing bar transmission assembly 22. The swing bar transmission assembly 22 couples the swing bar power device 21 and the central swing member 11. The swing bar power device 21 drives the central swing member 11 to swing through the transmission of the swing bar transmission assembly 22.

The swing bar power device 21 may adopt a rotary motor or an extension-retraction motor. The swing bar transmission assembly 22 is configured to match the output power of the swing bar power device 21 with the central swing member 11. For example, a rotating force of the rotary motor is converted into a pushing force in the left-right direction of the central swing member 11. Or, when an extension-retraction direction of an extension-retraction shaft of the extension-retraction motor is not in a same direction as a swinging direction of the central swing member 11, the swing bar transmission assembly 22 may drive the central swing member 11 to swing when the extension-retraction shaft extends or retracts.

As shown in FIGS. 4 and 5, the swing bar transmission assembly 22 includes a swing bar input gear 221 and a swing bar output gear 222 coupled in a transmission manner. The central swing member 11 is provided with a swing gear 111, the swing bar input gear 221 is coupled to the swing bar power device 21, and the swing bar output gear 222 is meshed with the swing gear 111.

In this embodiment, the swing bar power device 21 adopts a rotary motor, the swing bar input gear 221 is fitted over a rotating shaft of the rotary motor, and the rotating shaft drives the swing bar input gear 221 to rotate synchronously when rotating.

The swing bar input gear 221 may be meshed with the swing bar output gear 222 to directly drive the swing bar output gear 222 to rotate. The swing bar output gear 222 may also be indirectly driven through at least one swing bar transmission gear 223. As shown in FIG. 5, three swing bar transmission gears 223 are meshed sequentially, the swing bar transmission gear 223*a* is meshed with the swing bar input gear 221 and the swing bar transmission gear 223*b*, the swing bar transmission gear 223*c* is meshed with the swing bar transmission gear 223*b* and the swing bar output gear 222, and the rotating force of the swing bar input gear 221 is transmitted to the swing bar output gear 222 through the swing bar transmission gears 223*a*, 223*b* and 223*c* sequentially.

The swing gear 111 on the central swing member 11 is meshed with the swing bar output gear 222. An arc where the swing gear 111 is located is arranged along the width direction X of the body 001. The swing bar output gear 222 drives the swing gear 111 to rotate. The central swing member 11 is controlled to swing in the width direction X of the body 001 by controlling a rotating direction of the swing bar power device 21.

Alternatively or additionally, as shown in FIG. 4, the swing bar driving unit 02 is further provided with a driving housing 23, and the swing bar power device 21 and the swing bar transmission assembly 22 are mounted in the driving housing 23, thus improving the structural integrity and facilitating the assembly.

In one embodiment, as shown in FIG. 4, each swing arm 12 includes a first arm body 121, a second arm body 122, and a roller 123. One end of the first arm body 121 is rotatably coupled to the central swing member 11, and the other end of the first arm body 121 is rotatably coupled to one end of the second arm body 122. Restoring torsion springs (not shown in the figure) are coupled between the first arm body 121 and the central swing member 11 and between the first arm body 121 and the second arm body 122. The roller 123 is rotatably coupled to the other end of the second arm body 122.

The swing arm 12 is designed to two sections, namely the first arm body 121 and the second arm body 122. A rotation axis L1 of the first arm body 121 and the central swing member 11 is arranged along the length direction Y of the body 001. A rotation axis L2 of the second arm body 122 and the first arm body 121 is arranged along the height direction Z of the body 001 when the first arm body 121 rotates into a condition in which the first arm body 121 is arranged along the width direction of the body 001. In addition, the rotation axis L2 is always perpendicular to the rotation axis L1 during the rotation of the first arm body 121. Restoring torsion springs are coupled between the first arm body 121 and the central swing member 11 and between the first arm body 121 and the second arm body 122 to realize resilient restore of the swing arm 12.

The roller 123 is configured to reduce friction between the swing arm 12 and the traveling surface, so that the body 001 moves forward and drifts more smoothly.

Figure 7:
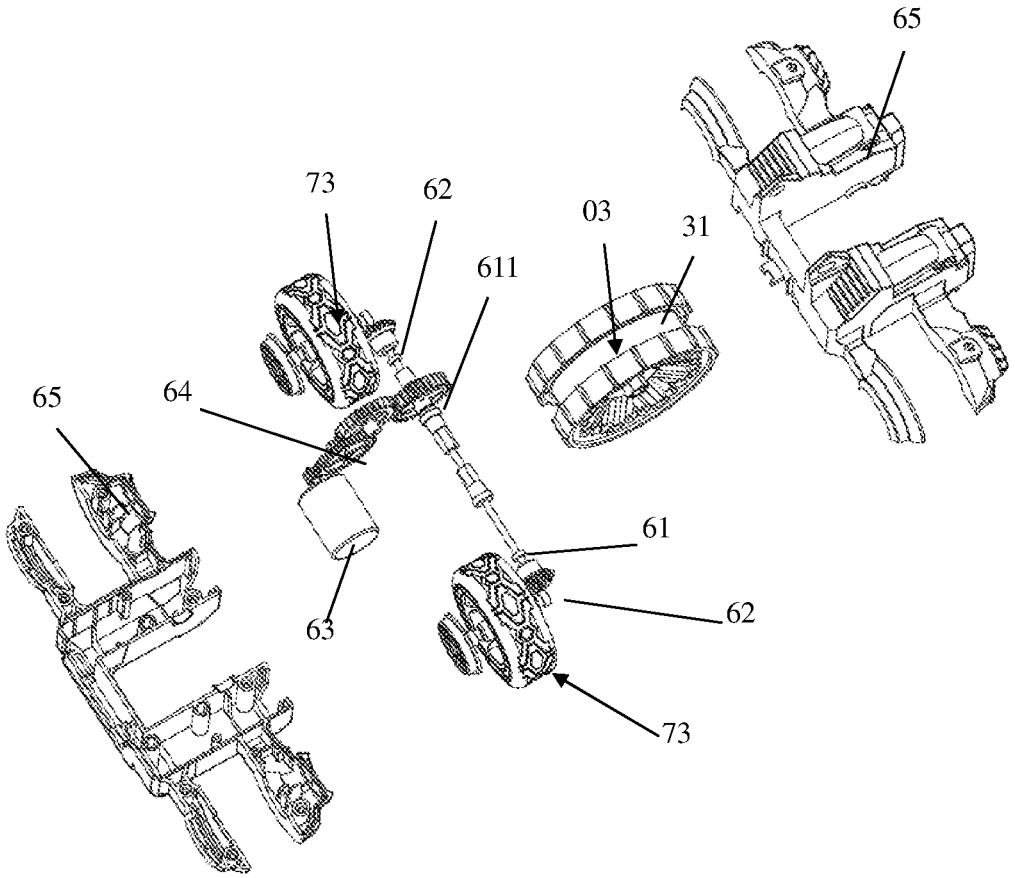
FIG. 7 is an exploded view of an advancing unit and a transverse moving unit according to an embodiment of the present disclosure.
Figure 8:
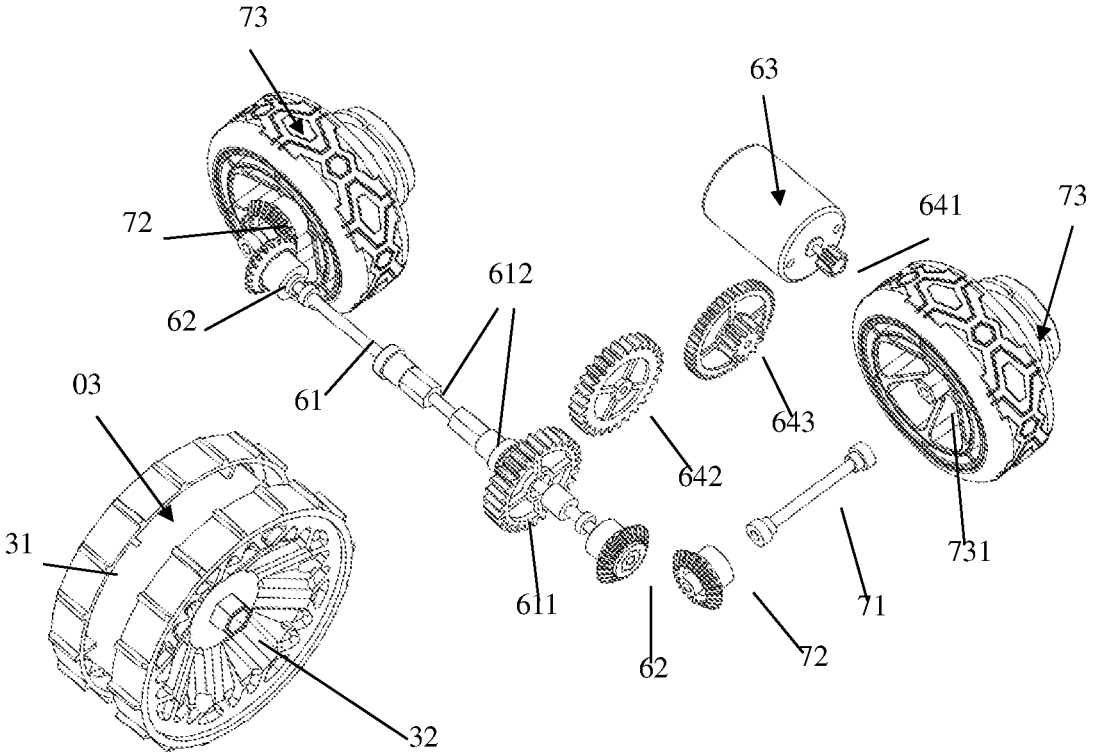
FIG. 8 is an exploded view of an internal structure of an advancing unit and a transverse moving unit according to an embodiment of the present disclosure.

In one embodiment, as shown in FIGS. 7 and 8, the transverse moving unit 004 includes two side wheel assemblies 07 respectively arranged at two sides of the body 001 and a power assembly 06 configured to drive the side wheel assemblies 07; a bottom end of the side wheel assembly 07 is higher than a bottom end of the advancing unit 002; and the power assembly 06 simultaneously drives two side wheel assemblies 07 to rotate through a transmission shaft 61. The side wheel assembly 07 at a side of the body 001 in a tilted direction is in contact with the traveling surface when the body 001 is in the tilting state.

The side wheel assembly 07 drives the body 001 to move along the width direction X when rotating, and the transmission shaft 61 is arranged along the width direction of the body 001. The two side wheel assemblies 07 are rotatably mounted at two ends of the transmission shaft 61, respectively. The power assembly 06 simultaneously drives the two side wheel assemblies 07 to rotate through the transmission of the transmission shaft 61.

The two side wheel assemblies 07 are not in contact with the traveling surface when the body 001 is in the upright state. The side wheel assembly 07 at the left side is in contact with the traveling surface when the body 001 tilts towards the left side, to provide the body 001 with the transverse power towards the left side. The side wheel assembly 07 at the right side is in contact with the traveling surface when the body 001 tilts towards the right side, to provide the body 001 with the transverse power towards the right side.

Specifically, as shown in FIG. 8, the side wheel assembly 07 includes a wheel shaft 71, a side wheel 73 and a first bevel gear 72; and the side wheel 73 is rotatably mounted on the wheel shaft 71, and the first bevel gear 72 is fixedly coupled to the side wheel 73; and each of the two ends of the transmission shaft 61 is fixedly coupled to a second bevel gear 62, the second bevel gear 62 is meshed with the first bevel gear 72, and the transmission shaft 61 drives the side wheel 73 to rotate through the first bevel gear 72 and the second bevel gear 62.

The side wheel 73 and the first bevel gear 72 are fitted over the wheel shaft 71. The first bevel gear 72 and the side wheel 73 are coupled through a clearance fit between a polygonal shaft core and a polygonal shaft hole. As shown in FIG. 8, the polygonal shaft core (not shown in the figure) is arranged to the first bevel gear 72, and the polygonal shaft hole 731 is arranged to the side wheel 73.

The power assembly 06 further includes a driving motor 63, the driving motor 63 drives the transmission shaft 61 to rotate, to drive the second bevel gears 62 at two ends to rotate synchronously, and the two second bevel gears 62 drive the two side wheels 73 to rotate around the wheel shafts 71, respectively.

In some examples, as shown in FIG. 8, a wheel transmission assembly 64 is further arranged between the driving motor 63 and the transmission shaft 61, and includes a wheel input gear 641 and a wheel output gear 642 which are coupled through a wheel transmission gear 643 in a transmission manner. The transmission shaft 61 is provided with a rotating gear 611, the wheel input gear 641 is coupled to the driving motor 63, and the wheel output gear 642 is meshed with the rotating gear 611.

The driving motor 63 drives the rotating gear 611 to rotate, the rotating gear 611 drives the wheel input gear 641 to rotate, the wheel input gear 641 drives the wheel output gear 642 to rotate through the wheel transmission gear 643, and the wheel output gear 642 drives the rotating gear 611 and the transmission shaft 61 to rotate, thus realizing the transmission of power from the driving motor 63 to the transmission shaft 61. A reduction ratio between the driving motor 63 and the transmission shaft 61 may be changed by changing the number of teeth of the wheel input gear 641, of the wheel output gear 642 and of the wheel transmission gear 643.

Alternatively or additionally, as shown in FIG. 7, the power assembly 06 further includes a wheel housing 65, and the driving motor 63 and/or the wheel transmission assembly 64 are mounted in the wheel housing 65, thus improving the structural integrity and facilitating the assembly.

In one embodiment, as shown in FIGS. 7 and 8, the advancing unit 002 includes a driving wheel 03, a driven wheel 04 and a track 05. The track 05 is fitted over the driving wheel 03 and the driven wheel 04. The driving wheel 03 drives the driven wheel 04 and the track 05 to rotate synchronously when rotating.

Specifically, the driving wheel 03 and the driven wheel 04 are located at a foremost end and a rearmost end of the body 001, respectively. A surface of the driving wheel 03 and a surface of the driven wheel 04 are each provided with a first snap portion 31/41, and an inner surface of the track 05 is correspondingly provided with a second snap portion 51 fitted with the first snap portion 31/41. The driving wheel 03 drives the track 05 to rotate, and the track 05 drives the driven wheel 04 to rotate when the driving wheel 03 rotates.

The advance of the body 001 is realized by the track, which makes the movement of the body 001 more stable and may adapt to various sites.

The first snap portion 31/41 may be designed as a notch, the second snap portion 51 may be correspondingly designed as a snap member, and the snap member is inserted into the notch to be fitted with the notch for positioning. Alternatively, the first snap portion 31/41 may be designed as the snap member, and the second snap portion 51 may be correspondingly designed as the notch. Alternatively, the first snap portion 31/41 may be designed as a combination of the notch and the snap member, and the second snap portion 51 may be correspondingly designed as a combination of the notch and the snap member. The notch of the first snap portion 31/41 is fitted with the snap member of the second snap portion 51, and the snap member of the first snap portion 31/41 is fitted with the notch of the second snap portion 51.

The driving wheel 03 is fixedly coupled to the transmission shaft 61. The transmission shaft 61 drives the driving wheel 03 to rotate synchronously when rotating. A driving wheel limiting shaft core 612 is fixedly provided on the transmission shaft 61. At least part of a cross section of the driving wheel limiting shaft core 612 is polygonal, and a driving wheel shaft hole 32 at a center of the driving wheel 03 is designed as a polygonal hole corresponding to the driving wheel limiting shaft core 612. The driving wheel limiting shaft core 612 is in a clearance fit with the driving wheel shaft hole 32, which is convenient for mounting and may effectively drive the driving wheel 03 to rotate.

Alternatively or additionally, the driving wheel 03 is arranged at a rear end of the body 001, and the driven wheel 04 is arranged at a front end of the body 001. The body 001 is driven from the rear end, so that the driving force is more stable. In addition, the driving components are mounted on the rear end, so that the body 001 has a more harmonious and beautiful structure and a higher degree of simulation. In addition, the motorcycle is driven at the rear end, so that the traveling is smoother, and motorcycle is not easy to roll over.

Specifically, as shown in FIG. 3, the driven wheel 04 is coupled to the body 001 through a shock mount 42, the shock mount 42 is in the form of a "C", and a rotating shaft of the driven wheel 04 is coupled to an opening of the shock mount 42.

In the embodiments of the present disclosure shown in FIGS. 1 to 8, the drift toy vehicle has three movement states:

a first state: when lengths of swing arms 12 at two sides of the balancing assembly 01 are identical, lower ends of the two swing arms 12 are in contact with the ground or the traveling surface, and the two side wheels 73 are suspended in midair. At this time, the driving motor 63 is started, and may drive the driving wheel 03 to rotate, and then to drive the track 05 to rotate, so that the motorcycle is driven to move forward;

a second state: the swing bar power device 21 is controlled to rotate in an A direction (see FIG. 5), and the driving motor 63 is started simultaneously. At this time, the balancing assembly 01 swings towards the left side, the lower end of the swing arm 12 at the left side and the side wheel 73 at the right side are in contact with the traveling surface, the body 001 tilts towards the right side, the side wheel assembly 07 at the left side and the lower end of the swing arm 12 at the right side are suspended in midair, and the toy vehicle drifts towards the right side under the drive of the driving wheel 03 and the side wheel assembly 07 at the right side; and a third state: the swing bar power device 21 is controlled to rotate in a B direction (see FIG. 5), and a wheel power device 61 is started simultaneously. At this time, the swing bar 01 swings towards the right side, the lower end of the swing arm 12 at the right side and the side wheel assembly 07 at the left side are in contact with the traveling surface, the body 001 tilts towards the left side, the side wheel assembly 07 at the right side and the lower end of the swing arm 12 at the left side are suspended in midair, and the toy vehicle drifts towards the left side under the drive of the driving wheel 03 and the side wheel assembly 07 at the left side.

In this embodiment, a power supply 004 of the driving motor 63 and the swing bar power device 21 is mounted in the body 001. Specifically, as shown in FIG. 2, each of the left housing 101 and the right housing 102 is provided with a battery housing 104 configured to mount the power supply 004. The power supply 004 adopts a storage battery. An opening of the battery housing 104 is arranged in an outer surface of the body 001, and a battery cover 105 is detachably covered on the opening.

The wheel power device 61 and the swing bar power device 21 may be controlled through a remote controller. A control circuit between the remote controller and the wheel power device 61 and between the remote controller and the swing bar power device 21 is not within the protection scope of the present disclosure, and the control circuit in the related art may be used, which will not be specifically described here.

The drift toy vehicle according to the present disclosure has the following advantages:

1. The tilting unit and the transverse moving unit are added. In a drifting process, the body may tilt by controlling the swing of the balancing assembly at two sides of the body. In cooperation with a drifting direction of the body, posture of the body in a drifting process of the motorcycle may be simulated, thus improving the simulation degree of the toy vehicle.
2. The track is arranged in the moving unit, so that the body moves more smoothly and can adapt to various sites.
3. Both the side wheel and the driving wheel are driven by the driving motor, so that one driving motor can simultaneously provide the advancing power and the transverse power of the body, thus reducing arrangement of driving parts, simplifying the structure and reducing the cost.

The above description is only the principles and preferred embodiments of the present disclosure. It should be noted that for those skilled in the art, several other variants may be made on the basis of the principles of the present disclosure, which should also be considered as the protection scope of the present disclosure.

What is claimed is:

1. A drift motorcycle, comprising:

a body provided with a tilting unit and a transverse moving unit and an advancing unit arranged on the body and configured to provide advancing power for the body, wherein the tilting unit is movably mounted on the body, and two ends of the tilting unit extend from two sides of the body to control the body to switch between an upright state and a tilting state; and wherein the transverse moving unit is arranged at the two sides of the body, and the transverse moving unit is configured to be in contact with a traveling surface when the tilting unit controls the body to switch to the tilting state, to generate transverse power along a width direction of the body.

2. The drift motorcycle according to claim 1, wherein the tilting unit comprises a balancing assembly and a driving assembly, the balancing assembly is movably arranged on the body, two ends of the balancing assembly are located at the two sides of the body respectively, and the balancing assembly comprises a balanced state and an unbalanced state;

the body is in the upright state when the balancing assembly is in the balanced state;

the body is in the tilting state when the balancing assembly is in the unbalanced state; and the driving assembly is configured to drive the balancing assembly to switch between the balanced state and the unbalanced state.

3. The drift motorcycle according to claim 2, wherein the tilting unit further comprises a balance detecting assembly mounted on the body, and the balance detecting assembly is directly facing a center position of the balancing assembly in the balanced state; and the driving assembly is controlled to stop driving in response to that the balance detecting assembly detects that the balancing assembly is in the balanced state when the balancing assembly switches from the unbalanced state to the balanced state.

4. The drift motorcycle according to claim 2, wherein the balancing assembly is a swing bar, a length direction of the swing bar is arranged along the width direction of the body, and two ends of the swing bar extend from a left side and a right side of the body respectively; and the driving assembly is configured to drive the swing bar to swing at the left side and the right side of the body, and an end of the swing bar extending from one side of the left side and the right side abuts against the traveling surface when the swing bar swings towards the one side, to tilt the body towards the other side.

5. The drift motorcycle according to claim 4, wherein the swing bar comprises a central swing member and two swing arms rotatably coupled to two ends of the central swing member, the swing arm extends obliquely towards the traveling surface, a coupling end of the swing arm is resiliently and rotatably coupled to the central swing member, and a free end of the swing arm at one side of the body abuts against the traveling surface when the central swing member swings towards the one side of the body.

6. The drift motorcycle according to claim 5, wherein each swing arm comprises a first arm body, a second arm body and a roller, one end of the first arm body is rotatably coupled to the central swing member, the other end of the first arm body is rotatably coupled to one end of the second arm body, restoring torsion springs are coupled between the first arm body and the central swing member and between the first arm body and the second arm body, and the roller is rotatably coupled to the other end of the second arm body.

7. The drift motorcycle according to claim 1, wherein the transverse moving unit comprises two side wheel assemblies respectively arranged at the two sides of the body and a power assembly configured to drive the side wheel assemblies, and a bottom end of the side wheel assembly is higher than a bottom end of the advancing unit; and the power assembly is configured to simultaneously drive the two side wheel assemblies to rotate through a transmission shaft, and the side wheel assembly at a side of the body in a tilted direction is configured to be in contact with the traveling surface when the body is in the tilting state.

8. The drift motorcycle according to claim 7, wherein the side wheel assembly comprises a wheel shaft, a side wheel and a first bevel gear, the side wheel is rotatably mounted on the wheel shaft, and the first bevel gear is fixedly coupled to the side wheel; and an end of the transmission shaft is fixedly coupled to a second bevel gear, the second bevel gear is meshed with the first bevel gear, and the transmission shaft is configured to drive the side wheel to rotate through the first bevel gear and the second bevel gear.

9. The drift motorcycle according to claim 1, wherein the advancing unit comprises a driving wheel, a driven wheel and a track, the track is fitted over the driving wheel and the driven wheel, and the driving wheel is configured to drive the driven wheel and the track to rotate synchronously when rotating.

10. The drift motorcycle according to claim 9, wherein a surface of the driving wheel and a surface of the driven wheel are each provided with a first snap portion, an inner surface of the track is correspondingly provided with a second snap portion fitted with the first snap portion, and the driving wheel is configured to drive the track to rotate, and the track is configured to drive the driven wheel to rotate when the driving wheel rotates.

* * * * *